US007272340B2

(12) United States Patent
Song

(10) Patent No.: US 7,272,340 B2
(45) Date of Patent: Sep. 18, 2007

(54) IMAGE FORMING APPARATUS

(75) Inventor: Eun-ho Song, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 26 days.

(21) Appl. No.: 11/234,264

(22) Filed: Sep. 26, 2005

(65) Prior Publication Data

US 2006/0115294 A1 Jun. 1, 2006

(30) Foreign Application Priority Data

Nov. 27, 2004 (KR) ..... 10-2004-0098363

(51) Int. Cl.
*G03G 21/16* (2006.01)

(52) U.S. Cl. ..... 399/111; 399/125

(58) Field of Classification Search ..... 399/107, 399/110, 111, 125

See application file for complete search history.

(56) References Cited

U.S. PATENT DOCUMENTS 5,896,206 A 4/1999 Kellogg 5,903,803 A * 5/1999 Kawai et al. ..... 399/116

FOREIGN PATENT DOCUMENTS

| | | |
|---|---|---|
| JP | 56-067858 | 6/1981 |
| JP | 59-039638 | 3/1984 |
| KR | 0159052 | 3/1999 |

* cited by examiner

*Primary Examiner*—David M. Gray
*Assistant Examiner*—Joseph S. Wong
(74) *Attorney, Agent, or Firm*—Roylance, Abrams, Berdo & Goodman, L.L.P.

(57) ABSTRACT

Provided is an image forming apparatus. The image forming apparatus includes a developer operating after being inserted in a body of the image forming apparatus and forming an image on a recording medium. A cover opens or closes the body such that the developer may be inserted in or removed from the body. A switchgear transmits a driving force to the developer or blocks the driving force from being transmitted to the developer according to whether the cover opens or closes the body. Therefore, gears are not damaged when the developer is inserted in or removed from the body of the image forming apparatus.

17 Claims, 6 Drawing Sheets

IMAGE FORMING APPARATUS

CROSS REFERENCE TO RELATED APPLICATION

This application claims the benefit under 35 U.S.C. § 119(a) of Korean Patent Application No. 10-2004-0098363, filed on Nov. 27, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus including a switchgear that facilitates the smooth engagement of gears without damaging the gears when a developer is inserted in a body of the image forming apparatus.

2. Description of the Related Art

Generally, an electrophotographic image forming apparatus prints an image by forming an electrostatic latent image on a photosensitive drum or a photosensitive belt and developing the electrostatic latent image using a predetermined type of toner. Such an electrophotographic image forming apparatus is typically classified as a dry electrophotographic image forming apparatus or a liquid electrophotographic image forming apparatus according to the toner used.

The liquid electrophotographic image forming apparatus uses ink containing a liquid carrier and solid toner at a predetermined ratio. The liquid electrophotographic image forming apparatus forms an image having superior print quality more easily, compared with the dry electrophotograhic image forming apparatus.

The electrophotographic image forming apparatus can also be classified into an adhesive transfer image forming apparatus or an electrostatic transfer image forming apparatus according to how a toner image is transferred.

In the adhesive transfer image forming apparatus, after a toner image is dried, the dried toner image is heated, pressed, and transferred onto a sheet of print paper by a transfer roller. The electrostatic transfer image forming apparatus transfers a toner image onto a sheet of print paper using an electrostatic force.

A removable developer, which stores toner and forms an electrostatic latent image, is installed in such an electrophotographic image forming apparatus. Thus, when the toner in the developer runs out, the developer is replaced with a new developer storing new toner to form an image. When the developer is installed in a body of the electrophotographic image forming apparatus, power can be transmitted as gears are engaged with each other.

FIGS. 1 and 2 are schematic side views of a conventional image forming apparatus illustrating the transmission of power when the developer is installed in a body of a conventional image forming apparatus. Referring to FIG. 1, a main motor 30 and a photosensitive medium driving gear 31 are installed on a side frame (not shown) of the body. The photosensitive medium driving gear 31 receives power from the main motor 30 through meshing between the teeth of the main motor 30 and the teeth of the photosensitive medium driving gear 31, thereby driving a photosensitive medium (not shown).

In the upper part of the side frame of the main body, a developing roller driving motor 10 and an idle gear 22, which is rotated by power transmitted from the developing roller driving motor 10, are installed. Also, a swing gear 23 is rotatably installed in a bracket 21, which is engaged with the idle gear 22 to be rotatable about the idle gear 22 as a rotation axis. The bracket 21 elastically rotates by being connected to an elastic unit 24.

A developer 40 includes a developing roller (not shown) and a photosensitive medium (not shown). A developing roller gear 41 transmitting power to the developing roller and a photosensitive medium gear 42 transmitting power to the photosensitive medium are installed to protrude from the developer 40.

When the developer 40 is pushed in a direction indicated by the arrow in FIG. 1 and inserted into the body, the developing roller gear 41 engages with the swing gear 23. Accordingly, the photosensitive medium gear 42 engages with the photosensitive medium driving gear 31. When the developing roller driving motor 10 rotates, power is sequentially transmitted to the idle gear 22, the swing gear 23, and the developing roller gear 41. When the main motor 30 rotates, power is sequentially transmitted to the photosensitive medium driving gear 31 and the photosensitive medium gear 42.

Conversely, when the developer 40 is removed from the body, the swing gear 23 is rotated in reverse to release the swing gear 23 from its engagement with the developing roller gear 41. Since the swing gear 23 is engaged with the developing roller driving motor 10 through the idle gear 22, an additional load is imposed on the swing gear 23 by the developing roller driving motor 10, thereby making it difficult for the developer 40 to be removed from the body. If the developer 40 is forcibly removed from the body, gears that are engaged with the developer 40 may be damaged.

Accordingly, a need exists for an improved image forming apparatus having an easily removable developer that substantially eliminates damage to the gears upon removal.

SUMMARY OF THE INVENTION

The present invention provides an image forming apparatus including a switchgear that substantially prevents gears from being forcibly disengaged from each other when a developer is removed from a body of the image forming apparatus and disengages the gears from each other such that the gears are not damaged.

According to an aspect of the present invention, there is provided an image forming apparatus including a developer operating after being inserted in a body of the image forming apparatus and forming an image on a recording medium. A cover opens or closes the body such that the developer may be inserted in or removed from the body. A switchgear transmits a driving force to the developer or blocks the driving force from being transmitted to the developer according to whether the cover opens or closes the body.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown. The invention may, however, be embodied in many different forms and should not be construed as being limited to the exemplary embodiments set forth herein; rather, these embodiments are provided so that this disclosure is thorough and complete, and fully conveys the concept of the exemplary embodiments of the invention to those skilled in the art.

Figure 1:
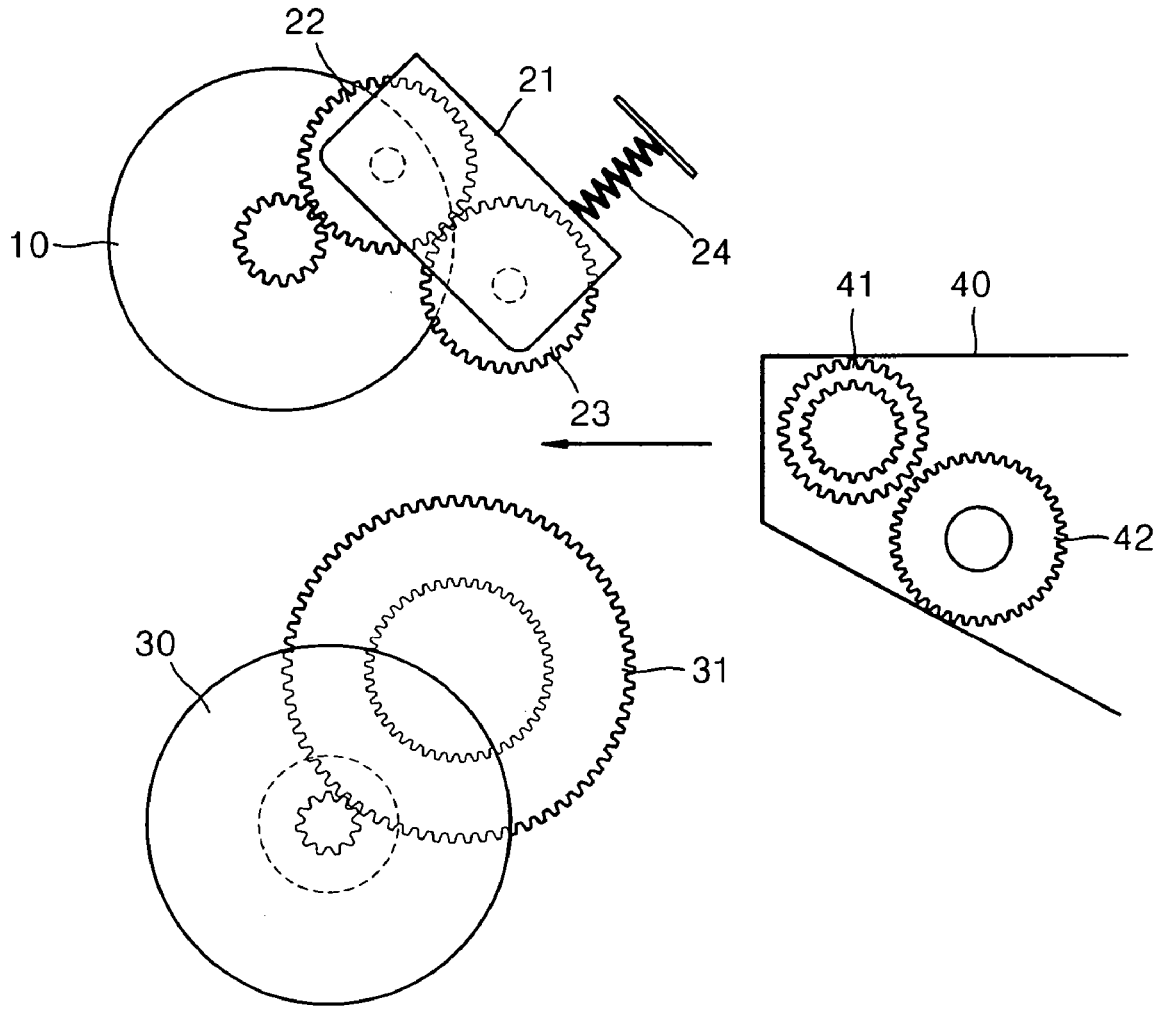
FIG. 1 (PRIOR ART)
FIGS. 1 and 2 are schematic side views of a conventional image forming apparatus illustrating the transmission of power when a developer is installed in a body of a conventional image forming apparatus.
Figure 2:
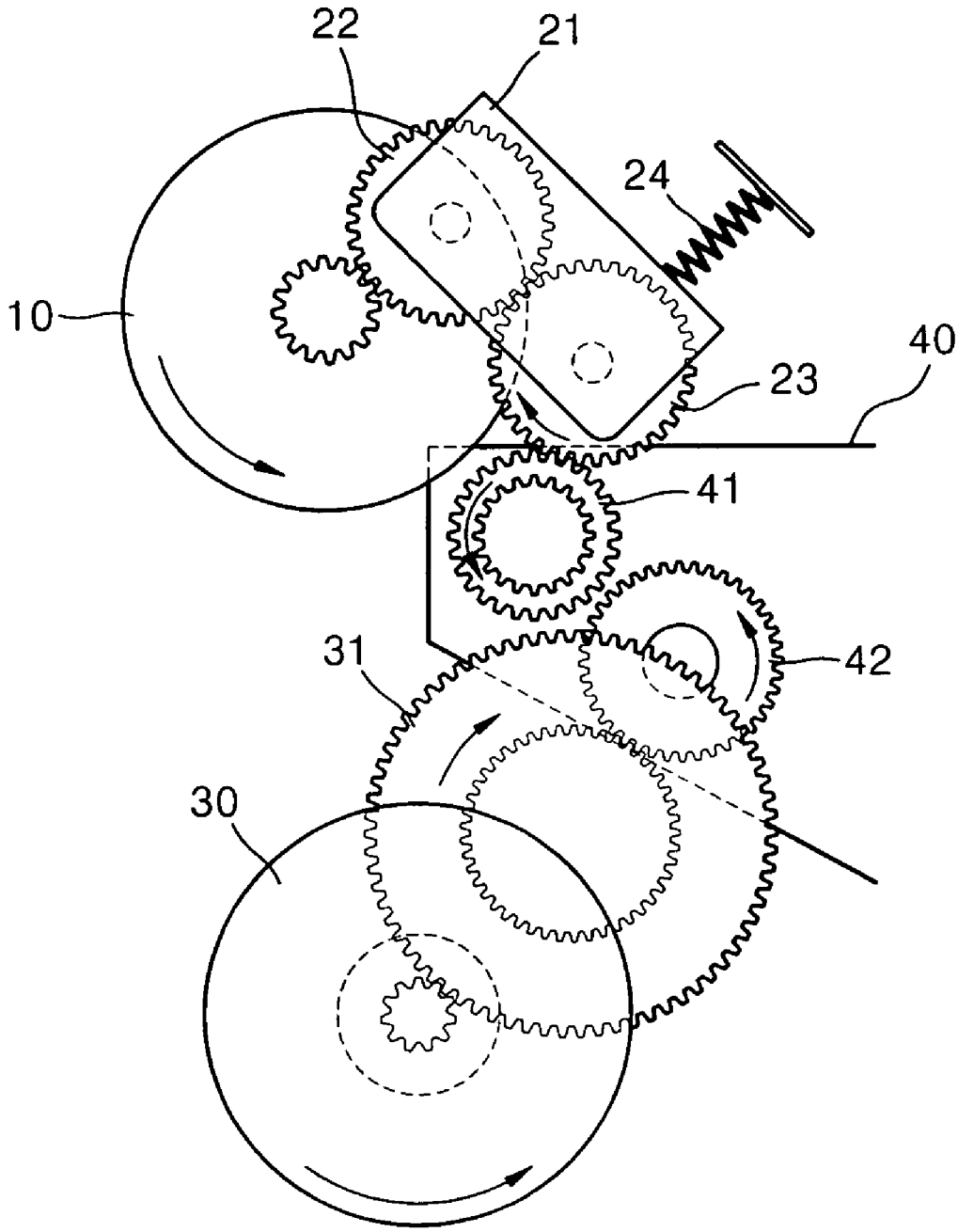
FIG. 2 (PRIOR ART)
Figure 3:
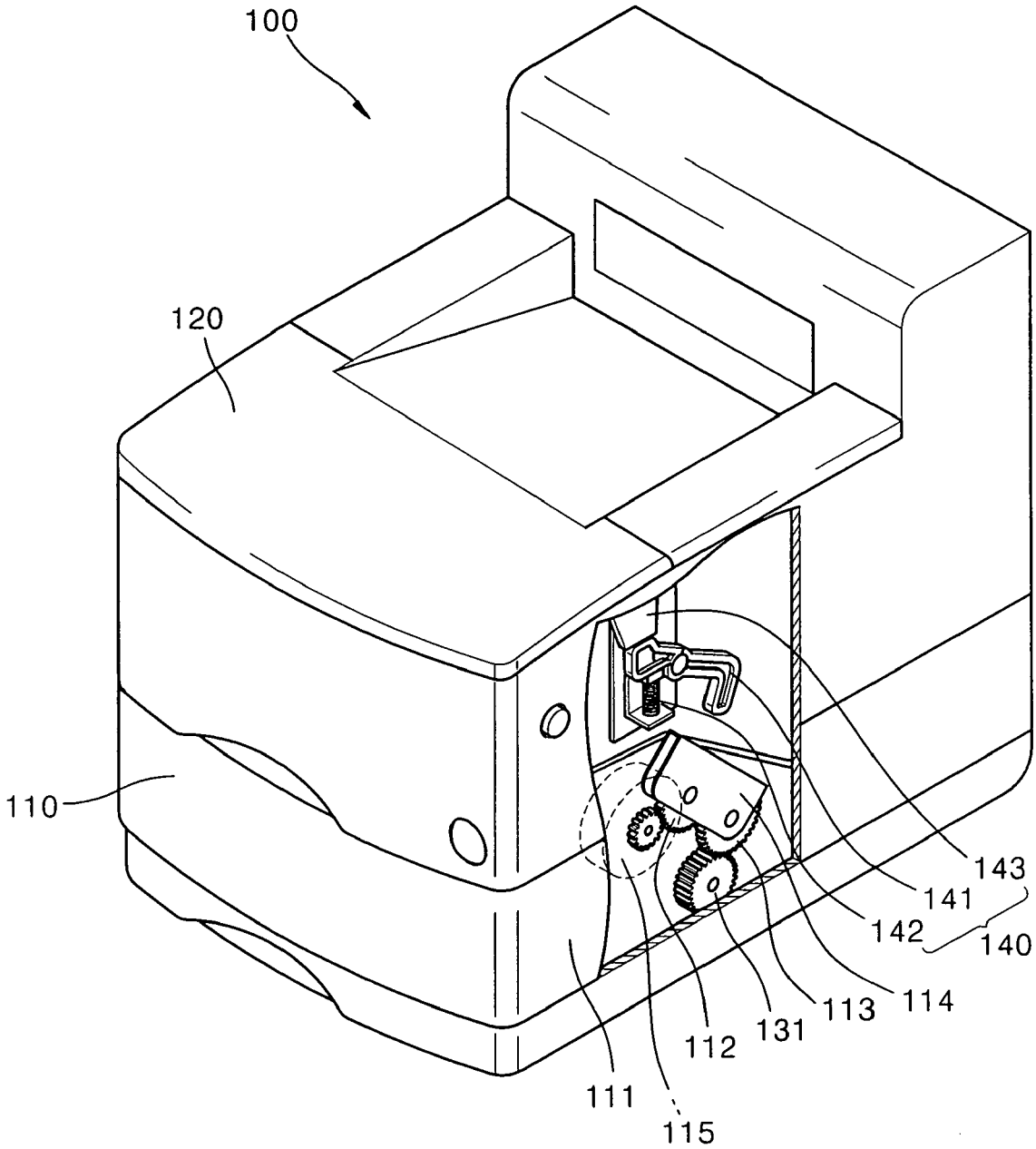
FIGS. 3 and 4 are perspective views of an image forming apparatus including a switchgear according to an exemplary embodiment of the present invention.
Figure 4:
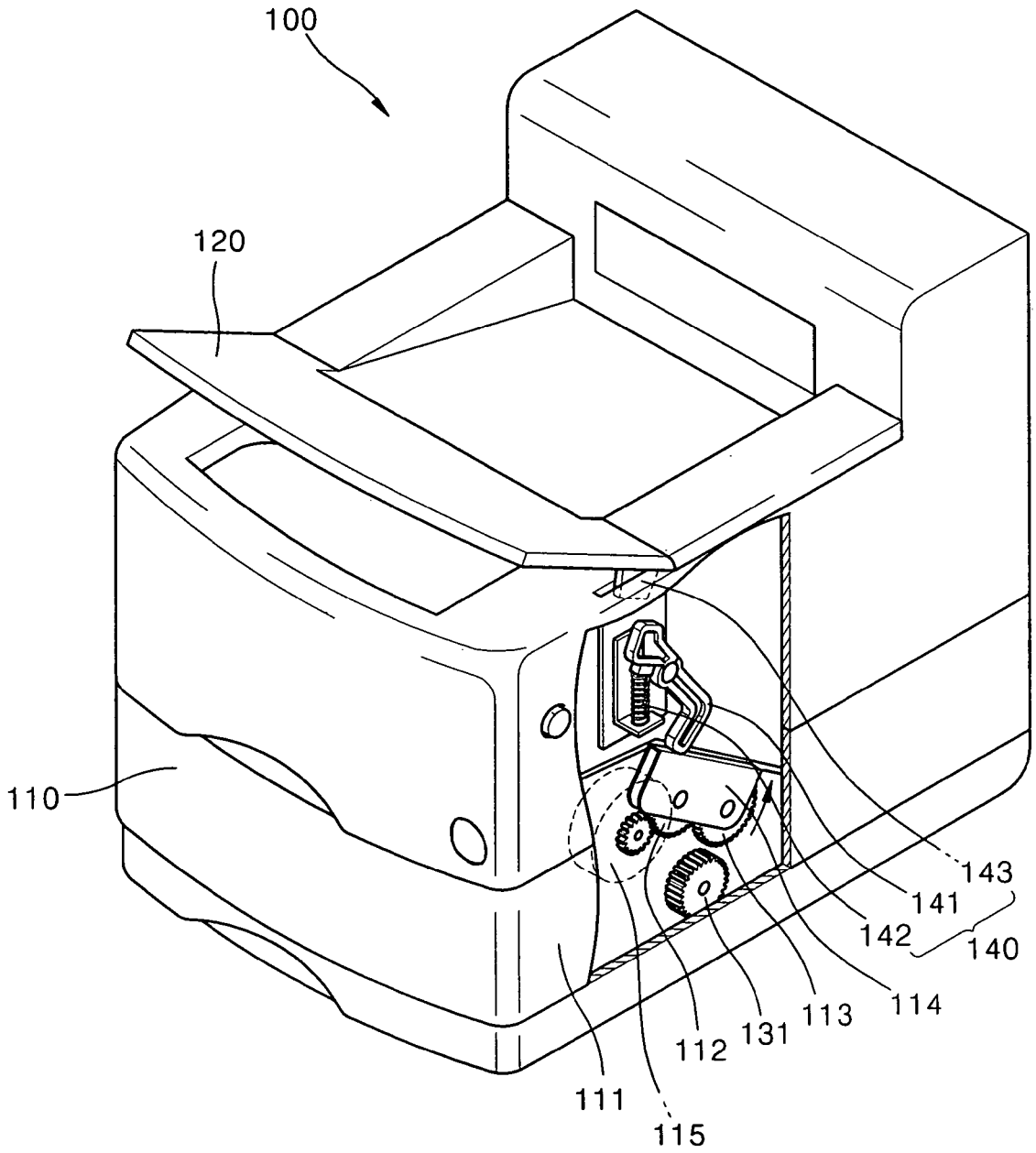

Referring to FIGS. 3 and 4, an image forming apparatus 100 includes a body 110, a cover 120, a developer 130 (see FIGS. 5 and 6), and a switchgear 140. The cover 120 is opened or closed in an upward direction with respect to the body 110. The developer 130 develops an image by being inserted in or removed from the body 110. The switchgear 140 smoothly engages or disengages gears when the developer 130 is inserted in or removed from the body 110.

A bracket 114 is installed in a side frame 111 of the body 110 and includes a speed-reducing gear 112 rotatably connected to a developing roller driving motor 115 and an idle gear 113 rotatably connected to the speed-reducing gear 112. The bracket 114 supports the idle gear 113 to rotate about the speed-reducing gear 112.

The switchgear 140 includes a rotating member 141, an elastic member 142, and a locking member 143. The rotating member 141 is installed in the side frame 111 of the body 110 such that the rotating member 141 may rotate in an upward or downward direction in the drawing. The rotating member 141 includes a hook unit 1411 (FIGS. 5 and 6), which may contact the bracket 114, on one end (a first end) thereof and an external force working unit 1412 (FIGS. 5 and 6) on the other end (a second end) thereof to allow an external force to work as the external force working unit 1412 contacts the locking member 143. The rotating member 141 is installed in the side frame 111 of the body 110 such that the rotating member 141 rotates about a hinge axis 1413 (FIGS. 5 and 6).

Figure 5:
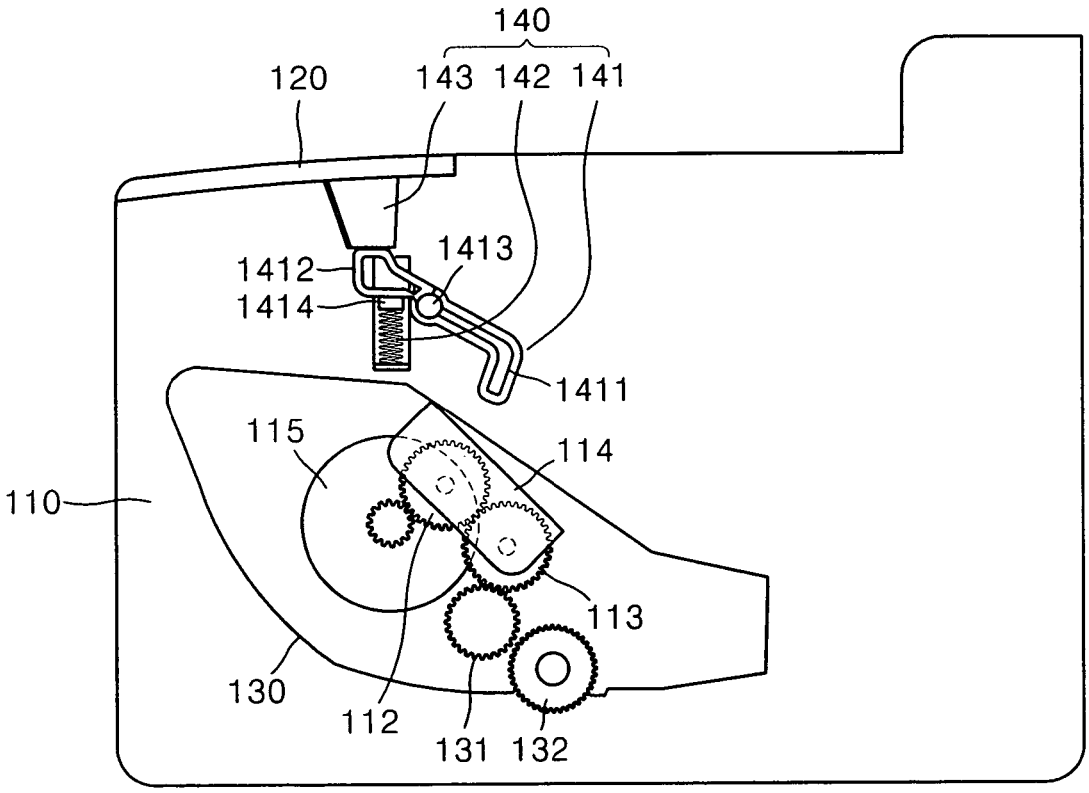
FIGS. 5 and 6 are schematic elevational views illustrating an operation of the image forming apparatus including the switchgear of FIGS. 3 and 4.
Figure 6:
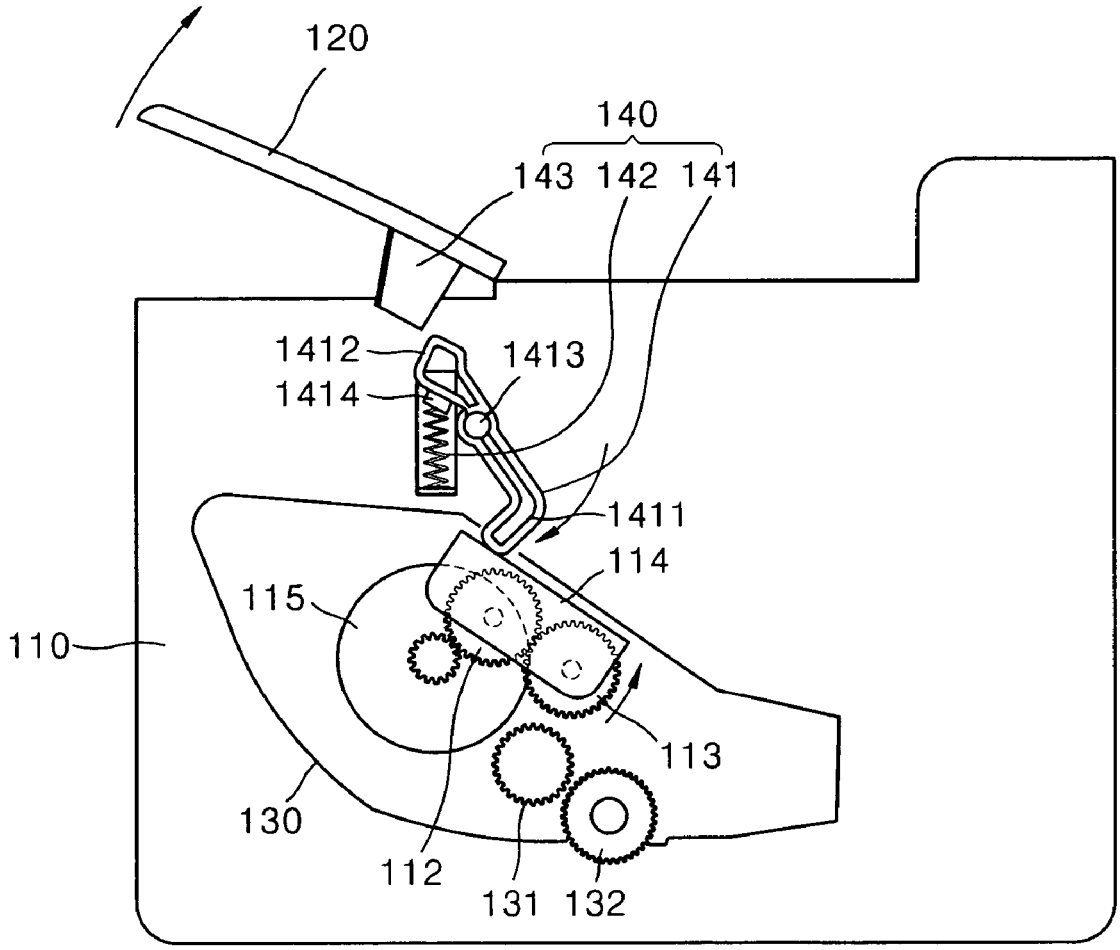

Referring to FIGS. 5 and 6, the elastic member 142 elastically biases the external force working unit 1412 of the rotating member 141 in an upward direction. One end of the elastic member 142 is fixed to a protrusion unit 1414 that protrudes from the external force working unit 1412, and the other end of the elastic member 142 is fixed to the side frame 111 of the body 110.

Since the external force does not work as long as the external force working unit 1412 does not contact the locking member 143 and the external force working unit 1412 is elastically biased in the upward direction by elastic force of the elastic member 142, the rotating member 141 rotates in a clockwise direction.

The locking member 143 protrudes from one side of the cover 120 in a downward direction. When the cover 120 of the body 110 is closed, the locking member 143 contacts and pushes down the external force working unit 1412. When the cover 120 of the body 110 is opened, the locking member 143 is separated from the external force working unit 1412. In this case, as the external force working unit 1412 is elastically biased by the elastic member 142 in the upward direction, the external force working unit 1412 returns to its original position.

The locking member 143 may face the elastic member 142 with the external force working unit 1412 disposed therebetween since the rotating member 141 is operated by the interaction between the locking member 143 and the elastic member 142.

The operation of the switchgear 140 thus structured will now be described with reference to the drawings. Referring to FIG. 5, when the developer 130 is inserted into the body 110, a developing roller gear 131 protrudes from a side of the developer 130 and engages the idle gear 113 to transmit power.

When the cover 120 is closed after the developer 130 is inserted in the body 110, the locking member 143 contacts the external force working unit 1412, thereby rotating the rotating member 141 about the hinge axis 1413. The elastic member 142 is compressed as the rotating member 141 rotates.

The developing roller gear 131 is rotated by power transmitted from the developing roller driving motor 115 through the speed-reducing gear 112 and the idle gear 113. The photosensitive medium gear 132 is rotated by power transmitted from a main motor (not shown).

Referring to FIG. 6, when the cover 120 of the body 110 is opened to remove the developer 130 from the body 110, the locking member 143 moves in the upward direction, together with the cover 120.

The locking member 143 is separated from the external force working unit 1412, and the external force working unit 1412 is elastically biased again by the elastic force of the elastic member 142 in the upward direction and returns to its original position.

As the rotating member 141 rotates about the hinge axis 1413 in the clockwise direction, the hook unit 1411 contacts the bracket 114, thereby rotating the bracket 114 about the speed-reducing gear 112 in a counter-clockwise direction.

As the bracket 114 rotates in the counter-clockwise direction, the idle gear 113 is separated from the developing roller gear 131. In other words, the idle gear 113 is disengaged from the developing roller gear 131. In this state, a user may remove the developer 130 from the body 110 and insert a new developer into the body 110.

When the cover 120 of the body 110 is closed, the locking member 143 contacts the external force working unit 1412, thereby rotating the rotating member 141 in the counter-clockwise direction. Accordingly, the hook unit 1411 is separated from the bracket 114. Then, the bracket 114 is rotated about the speed-reducing gear 112 by its own weight, thereby engaging the idle gear 113 with the developing roller gear 131 as illustrated in FIG. 5.

As described above, an image forming apparatus according to an exemplary embodiment of the present invention uses a switchgear, which disengages gears, to separate a developer from its body without damaging the gears.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

a developer operating after being inserted in a body of the image forming apparatus to form an image on a recording medium;

a cover opening or closing the body such that the developer isinsertable in and removable from the body; and a switchgear allowing a driving force to be transmitted to the developer or blocking the driving force from being transmitted to the developer according to whether the cover opens or closes the body, the switchgear including an elastic member that is compressed when the cover is closed.

2. The apparatus of claim 1, wherein the developer includes a photosensitive medium gear and a developing roller gear, and the switchgear transmits the driving force to the developing roller gear when the cover closes the body and blocks the driving force from being transmitted to the developing roller gear when the cover opens the body.

3. The apparatus of claim 2, wherein the body includes a bracket having a speed-reducing gear and an idle gear to transmit the driving force to the developing roller gear, and the bracket rotates about the speed-reducing gear as a rotation axis, and the switchgear transmits the driving force to the developing roller gear or blocks the driving force from being transmitted to the developing roller gear by rotating the bracket according to whether the cover opens or closes the body.

4. The apparatus of claim 3, wherein the switchgear includes a rotating member rotatably installed in the body and having a hook unit adapted to contact the bracket with one end thereof and an external force working unit on which an external force is adapted to work at the other end thereof;

the elastic member elastically biasing the external force working unit in an upward direction; and a locking member connected to the cover and adapted to rotate the rotating member by being separated from or contacting the external force working unit according to whether the cover opens or closes the body.

5. The apparatus of claim 1, wherein the switchgear is installed on one side of the body.

6. An image forming apparatus, comprising:

a developer removably disposed in an image forming apparatus, the developer having a developing roller gear;

a cover connected to the image forming apparatus and movable between open and closed positions;

a developing roller driving motor disposed in the image forming apparatus for transmitting a driving force;

a switchgear that prevents the driving force from being transmitted to the developer roller gear when the cover is in the open position and allows the driving force to be transmitted to the developer roller gear when the cover is in the closed position, the switchgear including an elastic member that is compressed when the cover is closed.

7. An image forming apparatus according to claim 6, wherein a photosensitive medium gear and a developing roller gear are connected to the developer.

8. An image forming apparatus according to claim 7, wherein the switchgear transmits the driving force to the developing roller gear.

9. An image forming apparatus according to claim 6, wherein a bracket having a speed-reducing gear and an idle gear is disposed in the image forming apparatus, the speed-reducing gear and the idle gear transmitting the driving force from the developing roller driving motor to the developing roller gear.

10. An image forming apparatus according to claim 9, wherein the bracket rotates about the speed-reducing gear as a rotation axis.

11. An image forming apparatus according to claim 6, wherein the switchgear prevents the bracket from rotating to prevent the driving force from being transmitted to the developing roller gear.

12. An image forming apparatus according to claim 6, wherein the switchgear includes a rotating member rotatably installed in the image forming apparatus and having a hook unit adapted to contact the bracket with a first end thereof and an external force working unit adapted to receive an external force at a second end thereof;

the elastic member elastically biasing the external force working unit in an upward direction; and a locking member connected to the cover and adapted to rotate the rotating member by being separated from the rotating member when the cover is in the closed position and adapted to contact the external force working unit to prevent rotation of the rotating member when the cover is in the open position.

13. An image forming apparatus according to claim 12, wherein the rotating member rotates about an axis positioned between the first and second ends.

14. A method of removing and inserting a developer from and in an image forming apparatus, comprising the steps of disengaging a locking member from a rotating member by opening a cover of the image forming apparatus;

rotating the rotating member in response to being disengaged from the locking member;

contacting a bracket with the rotating member to prevent rotation of the bracket;

stopping rotation of gears connected to the bracket and to the developer by preventing rotation of the bracket; and removing the developer without damaging the gears by stopping rotation of the gears.

15. A method of removing and inserting a developer from and in an image forming apparatus according to claim 14, further comprising inserting a new developer in the image forming apparatus;

engaging a locking member with a rotating member by closing the cover of the image forming apparatus;

rotating the rotating member in response to being engaged by the locking member;

separating the rotating member from the bracket to allow rotation of the bracket; and rotating the gears connected to the bracket and to the developer by allowing rotation of the bracket.

16. A method of removing and inserting a developer from and in an image forming apparatus according to claim 14, wherein the rotating member is rotated by a spring.

17. A method of removing and inserting a developer from and in an image forming apparatus according to claim 16, further comprising compressing the spring by engaging the locking member with the rotating member.

* * * * *